US009300084B2

(12) United States Patent
Wimmer

(10) Patent No.: US 9,300,084 B2
(45) Date of Patent: Mar. 29, 2016

(54) ELECTRICAL CONNECTOR AND ELECTRICAL CONNECTION HAVING A CONNECTOR

(71) Applicant: Lisa Dräxlmaier GmbH, Vilsbiburg (DE)

(72) Inventor: Wolfgang Wimmer, Salching (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 17 days.

(21) Appl. No.: 14/227,684

(22) Filed: Mar. 27, 2014

(65) Prior Publication Data

US 2014/0295685 A1 Oct. 2, 2014

(30) Foreign Application Priority Data

Mar. 27, 2013 (DE) ..... 10 2013 205 447

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC ..... H01R 13/6272; H01R 13/6275; H01R 13/641
USPC ..... 439/352, 489, 353
See application file for complete search history.

(56) References Cited

U.S. PATENT DOCUMENTS

| | | | | |
|---|---|---|---|---|
| 6,261,116 | B1 | 7/2001 | Ceru | |
| 6,435,895 | B1 * | 8/2002 | Fink et al. | 439/352 |
| 6,439,915 | B2 * | 8/2002 | Kurimoto | 439/352 |
| 6,780,045 | B2 * | 8/2004 | Shuey et al. | 439/489 |
| 7,326,074 | B1 * | 2/2008 | Lim et al. | 439/352 |
| 7,399,195 | B2 * | 7/2008 | Kim et al. | 439/352 |
| 7,544,081 | B2 * | 6/2009 | Lim | 439/352 |
| 7,909,638 | B2 * | 3/2011 | Seo et al. | 439/489 |
| 8,747,146 | B2 * | 6/2014 | Brown et al. | 439/489 |
| 2012/0282791 | A1 | 11/2012 | Brown et al. | |

* cited by examiner

*Primary Examiner* — Hae Moon Hyeon
(74) *Attorney, Agent, or Firm* — Finnegan, Henderson, Farabow, Garrett & Dunner LLP

(57) ABSTRACT

An electrical connector includes a housing, a latch arranged relative to the housing in a first direction, and a securing member arranged between the housing and the latch. The latch includes an engagement element configured to be movable in the first direction when not blocked. The securing member includes a supporting surface and a counter-engagement element. The supporting surface is configured to support the latch in the first direction. The engagement and counter-engagement elements are configured such that when the engagement and counter-engagement elements are engaged with each other, a displacement of the securing element in and against a second direction relative to the housing is constrained, and when the engagement and counter-engagement elements are disengaged from each other, the securing element is adjustable relative to the housing along the second direction.

9 Claims, 3 Drawing Sheets

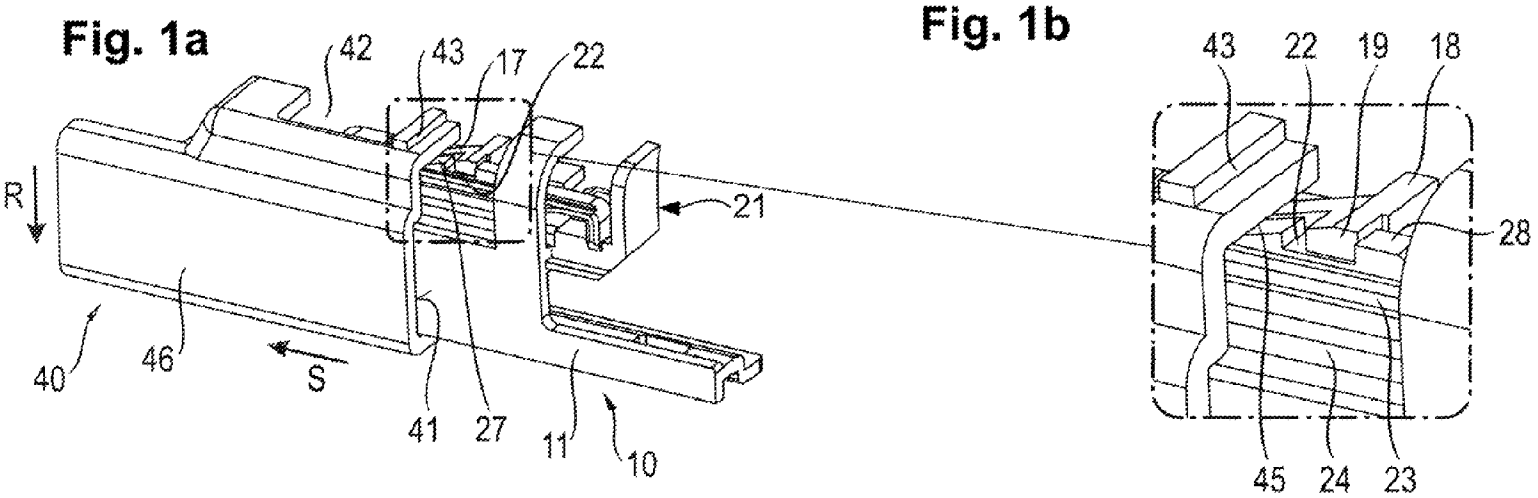
Fig. 1b
Fig. 1a
28
18
19
22
43
23
24
45
21
22
17
43
42
27
41
10
11
S
46
40
R
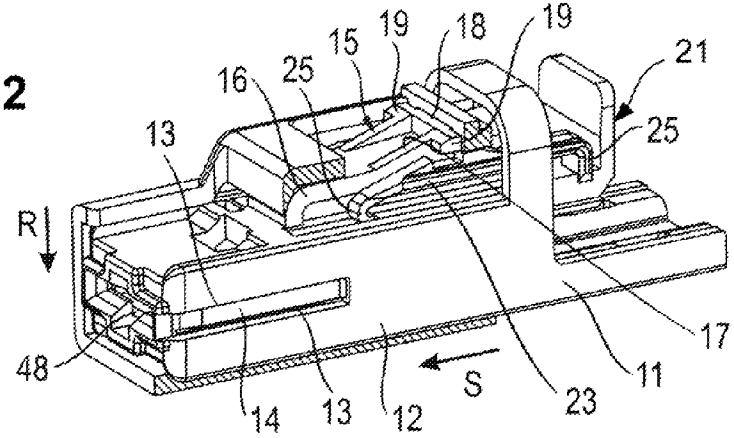
Fig. 2
21
25
19
18
19
15
25
16
13
17
11
23
S
12
13
14
48
R

ELECTRICAL CONNECTOR AND ELECTRICAL CONNECTION HAVING A CONNECTOR

CROSS-REFERENCE TO RELATED APPLICATIONS

This application is based upon and claims the benefit of prior German Application No. 10 2013 205 447.5, filed on Mar. 27, 2013, the entire content of which is incorporated herein by reference.

TECHNOLOGY FIELD

The disclosure relates to an electrical connector, especially for use in vehicles and, more particularly for use in motor vehicles. The connector according to the disclosure may be used in, e.g., an electrical system. The disclosure relates especially to a securing member for realizing a so-called Connection Position Assurance (CPA).

BACKGROUND

Electrical connectors are generally inserted manually into a connection. The required insertion force varies depending upon the number of poles, the contact and the housing design (sealed or unsealed). If the connector housings are not fully joined together, the electrical contact between the contact members may well be established, but the tightness and vibration resistance of the connection may be compromised, or the connection may loosen after some time and give rise to operating failures. To ensure that the housings are properly locked, securing members are applied. These help the CPA recognize a properly closed connection and prevent accidental release of the connection or its locking. Other application fields besides those mentioned above, where such a CPA is required, are conceivable.

The electrical connections need to be arranged such that the vibrations developing during vehicle operation do not adversely affect the quality of the connection over the medium or long term. To ensure this, the securing members are applied. A further object of the CPA is to indicate that the housings of the connection are properly inserted. Only when properly inserted can the CPA be placed in the end position (secured position) and accidental release of the housings prevented. Thus it can be ensured during installation that the electrical connection was fully realized and the connectors were fully connected. The manufacture and installation of the connection concepts should be done as resource-efficiently as possible, i.e., the expenditure of capital, time and materials should be minimal.

US patent No. 2012/0282791 A1 discloses a connector, where a latch is hinged resiliently on the housing of an electrical connector. The latch may be brought into engagement with a recess in the housing of a counterpart in order to lock the connection. Moreover, a separately formed securing member may be inserted in the housing of the connector as a CPA in order to block the latch in the latched position and prevent accidental release, whereby the securing member may be inserted only in the latched state. Providing separate members complicates the structure. Moreover, storing the separate members becomes more costly, and improper mounting of the securing member cannot be excluded.

SUMMARY

An object of the disclosure is to provide an electrical connector with a less complicated structure, that is safer to mount, and whose storage is less expensive.

This object is accomplished by a connector with the features recited in the independent claims. Advantageous developments of the disclosure are provided in the dependent claims, the description below, as well as the exemplary embodiment and the drawings.

The basic concept of the disclosure is to keep the securing member adjustable in the housing of the electrical connector, as well as temporarily block its displacement until the connector reaches a fully inserted position in the counterpart. Thus, on the one hand, the securing member being a component of the connector itself is realized, thereby avoiding the need for separate storage, and moreover, safety against loss is ensured. On the other hand, the fully inserted state of the connector in the counterpart is recognized in that the securing member can be adjusted only in the fully inserted state, while otherwise its displacement is temporarily blocked. Moreover, by adjusting the securing member, accidental release of the locking of the connector with the counterpart may be prevented by the latch, as in this so-called securing position, the latch is prevented from bouncing out of the recess in the counterpart.

Accordingly, the disclosure relates to an electrical connector, especially an electrical connector for use in vehicles, aircraft, commercial vehicles, agricultural machinery, especially motor vehicles. The term connector refers to a plug, a bushing, a coupling, a header, etc. The electrical connector includes a (first) housing. The housing may incorporate at least a first electrical contact member. The housing may be electrically insulating, and may be produced integrally of a suitable plastic.

Such a housing may be produced inexpensively in a conventional injection-molding process. The housing is arranged such that it may be inserted in a (second) housing of a counterpart, thereby electrically connecting the electrical contact members in their respective housings. In this fully inserted (locking) position, the housings are locked and/or latched by a locking (latching) device. Here, especially a latch is applied, which is mounted resiliently on the first housing in order to lock and/or latch in one latching direction perpendicular to the insertion direction and engages in a recess of the second housing of the counterpart. Due to this engagement, a form-locking connection is realized against the insertion direction in order to prevent separation of the housing of the electrical connector and the counterpart. Moreover, a securing member is provided, which includes a support surface, and which upon reaching the locking position, is adjustable relative to the first housing of the electrical connector into a securing position. In the securing position, the support surface supports the latch in the latching direction, such that it is only able to bounce slightly or not at all, and, however, in any case, is not detachable from the rear handle and the recess form closure. In accordance with the disclosure, the securing member is kept adjustable in the insertion direction on the housing. Both the latch and the securing member include an engagement means and a counter-engagement means, respectively, engaging with one another. The engagement of the engagement means and the counter-engagement means ensures that the displacement of the securing member relative to the housing in or against the insertion direction is blocked. Thus, when joining the first housing, and before reaching the fully inserted position, the securing member is not, or is only slightly adjustable in the insertion direction relative to the housing. Furthermore, the counter-engagement means is mounted resiliently in the latching direction, i.e., preferably in the same direction as the latch relative to the housing. Due to the resilience of the counter-engagement means against the spring action, the counter-engagement means may be disengaged from the engagement means of the latch, such that the securing member may be adjusted relative to the first housing and therefore also relative to the latch, and placed in the securing position. As the securing member is adjustable only if the latch is placed in the locking position, in which the latch engages in the recess of the counterpart or its housing, the fully secured position is recognized. In addition, providing an engagement and a counter-engagement means makes it possible for the securing member to recognize the fully locked state in the simplest way, while adjustment in the non-locked state is excluded. Furthermore, the displacement of the securing member made possible in this state and further insertion of the securing member in the securing position prevent accidental release of the latch, as in this position, the support surface of the securing member supports the latch in the latching direction, in which it is resilient, such that the latch is reliably prevented from bouncing out of the recess. By keeping the securing member adjustable on the housing of the electrical connector, safety against loss and installation-friendliness is ensured. Accordingly, a further advantage of the invention is that the (first) housing can be fully mounted by actuation, e.g., by pressing the securing member (CPA), and/or inserted into the (second) housing. Upon reaching the fully inserted position, the securing member automatically unlocks and may be pressed into the securing position.

According to an exemplary embodiment of the disclosure, the engagement means includes a projection extending perpendicular to the directions of latching and insertion, and the counter-engagement means includes a slot. According to another embodiment, the engagement means includes a pair of oppositely extending projections and the counter-engagement means includes two slots.

In order for the connector to be able to be re-released, a ramp is formed behind the engagement means as seen in the insertion direction. Thus, by pulling the securing member, the counter-engagement means may again spring into engagement with the engagement means of the latch, and the latch be released in this position in order to pull the electrical connector out of the counterpart.

In addition, in some embodiments, a release surface is formed behind the engagement means, as seen in the insertion direction. The release surface is arranged in order to enter into contact with a ridge limiting the recess in the insertion direction in front, when inserting the connector into the counterpart, in order to move the engagement means against its spring action in the latching direction relative to the housing, and therefore out of engagement with the engagement means of the latch. In other words, when inserting the connector and/or the first housing into the counterpart and/or the second housing, a ramp arranged before the counter-engagement means in the insertion direction engages initially with the ridge. Similarly, a ramp arranged before the end of the latch as seen in the insertion direction may engage with this ridge. Thus, both the latch and the counter-engagement means are exposed to pressure via both ramps due to the ridge, and "dip" beneath the ridge. After the ridge, the latch is resilient in the locking position, while the release surface remains in contact with the ridge, whereby the engagement means and the counter-engagement means loose contact. The latch with the engagement means is moved relative to the counter-engagement means. Thus, the securing member may be inserted further, until reaching the securing position.

In some embodiments, the securing member includes a handle, which is useful for inserting the connector and/or its housing in the counterpart and/or the housing. The housing can be fully mounted over the handle (see above).

In some embodiments, the securing member may be an integral component. In order for the counter-engagement means to be mounted resiliently, a material recess may be provided. Thus, it is conceivable, e.g., to integrate the counter-engagement means in a side panel extending parallel to the directions of insertion and latching, and fully penetrate this side panel in a direction perpendicular to the directions of latching and insertion. The result of this penetration is two shanks extending essentially parallel to the insertion direction, as well as two ridges extending in the latching direction. The counter-engagement means is provided in one of the shanks, which is arranged resiliently relative to the opposing shank via the ridge.

In some embodiments, the securing member includes a guide, in order to carry translationally and hold the securing member in the housing of the connector. In some embodiments, the guide for holding the securing member is arranged also as a form-fitting guide parallel to the latching direction and/or perpendicular to the insertion direction. Here, e.g., a T-slot or a dove-tail guide is an option. The guide may be provided, e.g., on the shank with the shanks facing the counter-engagement means (see above).

In some embodiments, the (first) housing of the electrical connector is slotted at least twice on one side in the insertion direction. Thus, a movable and/or resilient ridge perpendicular to the insertion direction is formed. When inserted in the counterpart and/or its (second) housing, this ridge comes into contact with a protrusion in the housing of the counterpart and is exposed to pressure in the direction of the (first) housing of the connector and/or shifted inward into the cavity of the (first) housing. The resilient ridge in the (first) housing resulting from the slotting presses, when fitted into the (second) housing, on a contact member in the first housing and thus prevents the contact member from oscillating in a direction perpendicular to the directions of insertion and/or latching. This will avoid contact corrosion. In other words, the contact member is squeezed between the opposing ridges. The contact member parallel to the latching direction is preferably prevented from oscillating by a pre-stressed secondary locking device, which holds the contact member against the insertion direction in a formfitting way in the (first) housing. The secondary locking device is exposed to pressure and/or pre-stressed due to the housing, e.g., two ascending ramps, one on the housing and one on the secondary locking device, in the latching direction, and thus presses the contact member against the bottom of the (first) housing, such that the said oscillation parallel to the latching direction is inhibited. In addition, the secondary locking device locks the contact member in the (first) housing. Furthermore, the (first) housing is also fixed by the springy ridges in a direction perpendicular to the insertion direction in the (second) housing of the counterpart, and oscillation of the (first) the housing in the (second) housing of the counterpart is inhibited.

Beside the electrical connectors, the disclosure also relates to an electrical connection with such a connector and a counterpart. The counterpart may include a housing (second housing) with a recess. The recess may be limited at its front end by a ridge, as seen in the insertion direction, behind which, the latch of the connector is latchable in order to realize the locking. Furthermore, the (second) housing of the counterpart may include a protrusion matching the movable ridge of the housing of the connector in order to realize the aforementioned mounting of the (first) housing of the connector in the (second) housing of the counterpart, and avoid contact corrosion.

Further features of the disclosure, which may be implemented separately or in combination with one or more of the above features, are provided in the following description of an exemplary embodiment with reference to accompanying drawings.

BRIEF DESCRIPTION OF THE DRAWINGS

FIG. 1*a* shows a longitudinally sectioned, perspective view of a connection according to an exemplary embodiment, and FIG. 1*b* is an enlarged representation of the detail indicated in FIG. 1*a*.

FIG. 2 shows a partly cut-out, perspective view of the connection in FIGS. 1*a* and 1*b*, in the fully latched position, whereby the securing member has yet to enter the securing position.

DESCRIPTION OF THE EMBODIMENTS

Figure 3B:
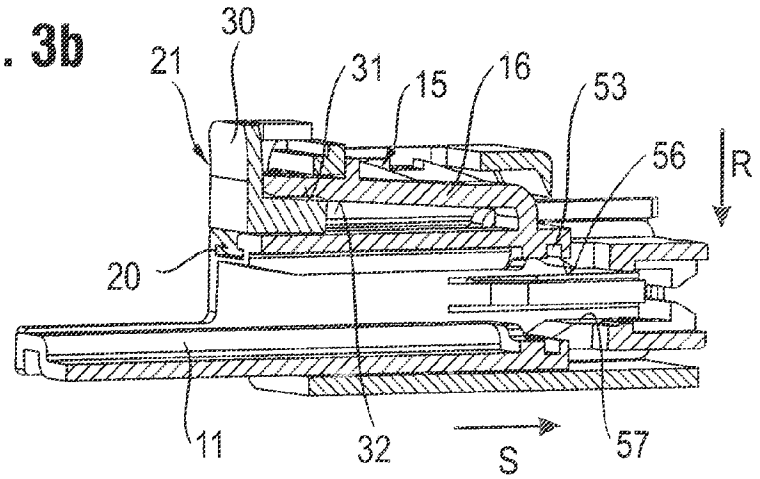
FIG. 3*b* shows a longitudinal section of the connection of FIG. 3*a*.

Like reference numerals identify like members in the different views.

FIGS. 1*a* and 1*b* show an electrical connection according to an exemplary embodiment of the disclosure. The electrical connection includes a connector 10 and a counterpart 40.

The counterpart 40 has a (second) housing 46 with a first cavity and an insertion opening 41 shown in FIG. 1*a* on the right-hand side. In the upper surface of housing 46, a recess 42 is provided, which is limited by a ridge 43. Here, ridge 43 is seen in the insertion direction S before the recess 42. The counterpart and/or housing 46 may be designed as a single housing or integrated in a distribution or fuse box.

The connector 10 includes a housing 11. Housing 11 may be inserted in the insertion direction S via opening 41 into housing 46 of the counterpart 40.

Figure 3C:
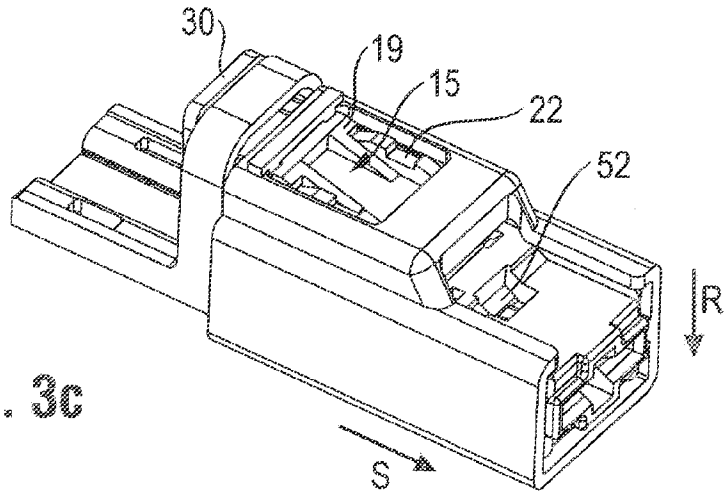
FIG. 3*c* shows a perspective view of a connection in the position in FIG. 3*a*.
Figure 3A:
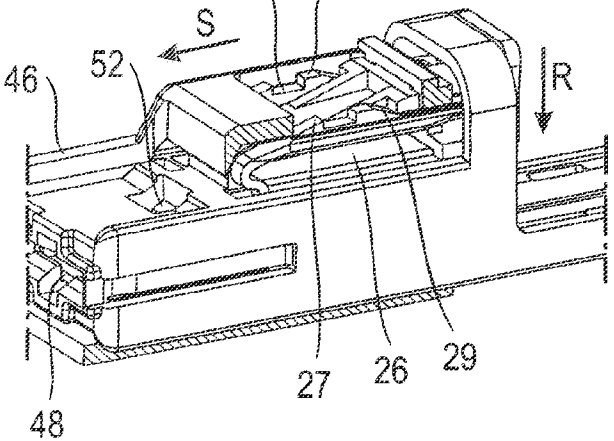
FIG. 3*a* shows a partially cut-away, perspective view of the connection in FIG. 2, wherein the securing member is in the securing position.
Figure 4:
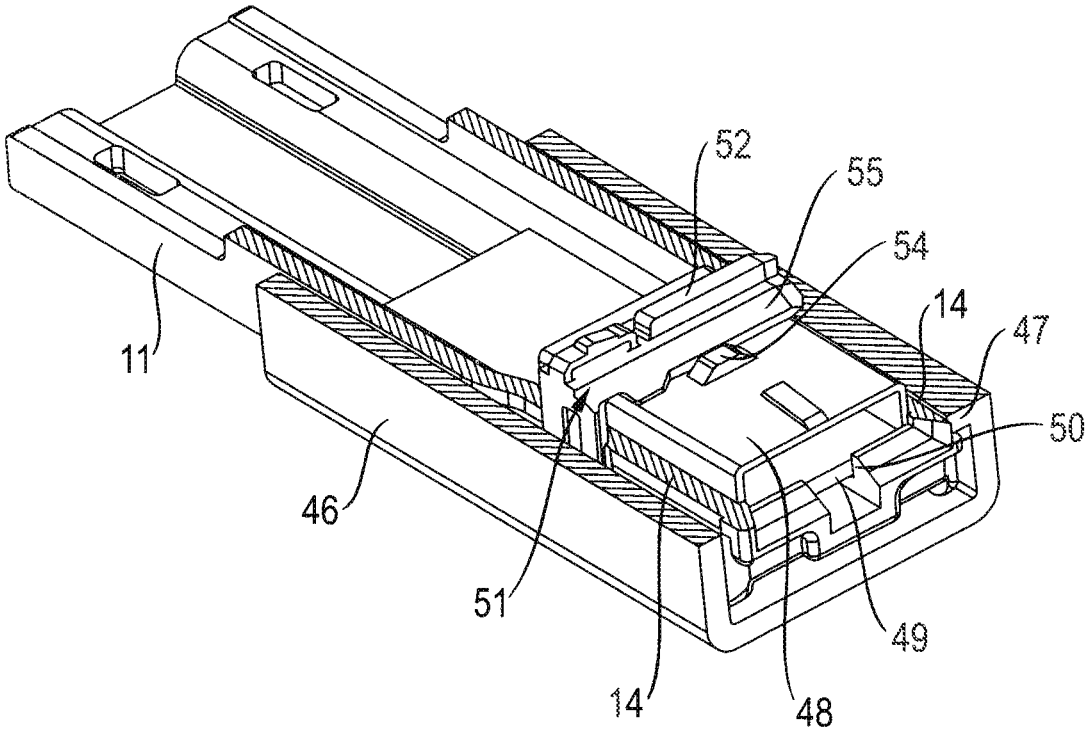
FIG. 4 is a perspective view of a horizontal section of the connection in FIG. 2 at the height of the ridge formed by slots in the housing.

As seen in FIGS. 2 and 3*a*, the housing, at its front end, as seen in the insertion direction S, has two parallel, spaced-apart slots 13 in both side panels 12, thus forming a movable and resilient ridge 14 in a direction perpendicular to the directions of insertion S and latching R, which will be described below. In FIGS. 2 and 3*a*, as well as FIG. 4, the ridges are shown in their inwardly pressed position. This is realized due to the formation of matching elongated ribs or projections 47 in the housing 46 of the counterpart 40, which, when housing 11 is inserted into housing 46 of the counterpart 40, come into contact with the ridges 14 and these, as shown in FIGS. 2, 3*a*, and 4, press inward.

Furthermore, a contact member 48 is incorporated in housing 11. With its end face 49, the contact member in housing 11 contacts an end stop 50 of housing 11. Furthermore, a secondary locking device 51 is provided, which has a ridge 52. The secondary locking device 51 is mounted via ridge 52, which engages in a slot 53 (FIG. 3*b*) of housing 11, relative to the housing parallel to the insertion direction S. In this position, depicted in FIG. 4, the contact member 48 is securely held between the end stop 50 and the secondary locking device 51 in the housing. For this purpose, a protrusion 54 of contact member 48 comes into contact with the secondary locking device 51, such that the secondary locking device 51 of contact member 48 stops in a form-fitting way against the insertion direction S in housing 11.

Due to the ridges 14, the contact member 48 is exposed to pressure and/or pre-stressed perpendicularly to the directions of insertion and latching, as described below, as in the inserted state, ridges 14 squeeze the contact member 48 from opposite sides. Oscillation of contact member 48 perpendicular to the insertion direction S and the latching direction R in housing 11 can thus be prevented reliably, and thus contact corrosion avoided. Furthermore, the secondary locking device 51 has a ramp 55 (FIG. 4). When inserting contact member 48 and the secondary locking device 51 into housing 11, this ramp comes into contact with a ramp 56 (FIG. 3*b*) in the cavity of housing 11, and/or ramp 55 ascends ramp 56. Thus, the secondary locking device 51 becomes pre-stressed or exposed to pressure in the latching direction R and/or toward the bottom 57 (FIG. 3*b*)) of the housing. Consequently, the secondary locking device 51 presses contact member 48 against the bottom 57 and prevents oscillation of the contact member 48 in housing 11 parallel to the latching direction R. This, too, reliably prevents contact corrosion.

Moreover, electrical contact member 48 is electrically connected with a not shown electrical conductor.

In addition, housing 11 on its upper surface has a latch 15. Latch 15 is resiliently mounted on housing 11 via a shank 16. Latch 15 with the shank 16 is thus an integral part of the housing 11. Two parallel-running ramps 17 are arranged before a latching area 18 of the latch, as seen in the insertion direction S. However, it is also conceivable to use only one continuous ramp, instead of two parallel ramps 17. Latching area 18 is formed by a panel protruding from shank 16. Furthermore, two engagement means 19 are formed on latch 15, extending in a lateral direction perpendicular to the insertion direction S and perpendicular to the latching direction R, thereby forming projections.

As seen in FIG. 3*b*, two T-slot guides 20 are provided in housing 11, wherein a securing member 21 is carried back and forth adjustably parallel to the insertion direction S and held at the housing 11.

Securing member 21 has a counter-engagement means 22. It is formed as a slot, which is made in a first shank 23 of two parallel shanks 23, 24. The counterpart for the T-slot guide is made in the second shank 24 of the parallel shanks 23, 24. The two parallel shanks 23, 24 are mounted resiliently relative to one another in direction R via the opposing ridge 25, whereby shank 24 is supported on housing 11, such that shank 23 is adjustable relative to shank 24 and/or housing 11 and latch 15. For this purpose, a material recess 26 is formed in a direction perpendicular to the directions of insertion S and latching R, which recess realizes the resilient mounting of the counter-engagement means 22.

As seen in FIG. 3*a*, the securing member 21 has two counter-engagement means in the form of slots.

Prior to establishing the connection, and as can be seen in FIG. 1*b*, the projections 19 of latch 15 are seated in slots 22 of the securing member, i.e., the engagement means 19 engages with the counter-engagement means 22. This prevents a securing member from shifting in or against the insertion direction S. The securing member can only be shifted together with housing 11, until the latch 15 snaps into place. After the engagement of latch 15, the securing member 21 automatically unlocks and enters the secured position (see FIG. 3*a*). Furthermore, as seen in the insertion direction S, a first ramp 27 is provided before the counter-engagement means and/or the slot. A release surface 28 is provided after the counter-engagement means 22, as seen in the insertion direction S, as is a further ramp 29, before the release surface 28 in the insertion direction. This ramp is likewise provided relative to both counter-engagement means 22. Furthermore, securing member includes a handle 30, with which the housing 11 and the safety device 21 may be pressed into housing 46 of the counterpart 40 in the insertion direction S. Moreover, as seen in FIG. 3*b*, a supporting surface 31 is provided at handle 30. When the securing member 21 (FIG. 3*b*) is in the securing position, this surface comes into contact with the lower surface 32 of shank 16, which comprises latch 15, and prevents springy movement of the latch 15 in the latching direction R.

The operation of the connection according to the disclosure will be explained below with reference to the figures.

As shown in FIG. 1, housing 11 of the connector is inserted in the insertion direction S via opening 41 into the cavity of housing 46 of the counterpart 40. A mechanic subsequently presses the handle 30 of securing member 21. While so doing, the ramp 17 of latch 15 and/or the ramp 27 of the securing member 21 come into contact with the lower surface 45 of ridge 43 (FIG. 1*b*). When moving the housing 11 further with the securing device 21 in the insertion direction S, latch 15 and the upper shank 23 of securing member 21 are pressed downward in the latching direction. The engagement means 19 thereby remain engaged in the counter-engagement means 22. Thus, in this state, displacement of the securing member 21 in the T-slot guides 20 remains inhibited relative to housing 11. If the latching area 18 of the latch 15 has surmounted ridge 43 in the insertion direction S, as shown in FIG. 2, it springs back against the latching direction R and engages behind ridge 43, while engaging in recess 42. This creates a form-locking connection of the housing 11 in housing 46 of the counterpart 40 in a direction opposite to the insertion direction S.

In this state (FIG. 2), the release surfaces 28 of securing member 21 come into contact with the lower surface 45 of ridge 43, such that the shank 23 is pressed downward, as previously, in the latching direction R. However, since latch 15, as explained, has already sprung back, the engagement means 19 disengage from the counter-engagement means 22, as shown in FIG. 2. Blocking of the displacement of securing member 21 in the T-slot guides 20 will therefore be canceled. By applying further pressure on handle 30, the securing member 21 may now be moved further relative to housing 11 and/or latch 15 in the insertion direction S and into the securing position, as shown in FIGS. 3*a*-3*c*. In the securing position, shank 23 springs back against the latching direction R, whereby ramp 29 comes into contact with the engagement means 19, and the securing member 21 is held in the securing position. Moreover, supporting surface 31 engages with the lower surface 32 of shank 16, on which shank, latching area 18 is also formed, and/or supports the shank. Thus, latch 15 is supported in the latching direction R and the latching area 18 cannot spring out of the form closure with ridge 43. Unintentional release of this form closure can therefore be prevented in a reliable fashion.

Furthermore, in this state, as already mentioned, the moveable ridge 14 of the housing 11 is exposed to inward pressure causing a further force-locking connection against the insertion direction S with the aforesaid advantages associated therewith.

In order to release the electrical connection, the user pulls on handle 30 of the securing member 21, whereby shank 23 is pressed downward via ramp 29, which abuts the engagement means 19. If the engagement means 19 and the counter-engagement means 22 are aligned with one another, latch 15 can be pushed down manually in the latching direction R in order to release the connection and pull the housing 11 out of housing 46 of the counterpart 40.

It is understood that the above-mentioned embodiment represents merely one way of implementing the disclosure. In this respect, it would likewise be conceivable to provide, e.g., only one counter-engagement means 19 and the members connected therewith. In addition, it is naturally also conceivable to provide alternative translational guides or implement the resilient mounting of latches and/or counter-engagement means by using separate spring members or other structures. Thus, various modifications of the disclosure are obvious to those skilled in the art.

If multiple connectors are applied, a coding may be placed on the side or lower surface in the form of several ribs. This will prevent incorrect insertion of the housings.

What is claimed is:

1. An electrical connector comprising:

a housing;

a latch mounted on the housing, the latch being arranged relative to the housing in a first direction and including an engagement element configured to be movable in the first direction when not blocked; and a securing member arranged between the housing and the latch, the securing member including:

a supporting surface configured to support the latch in the first direction; and a counter-engagement element, wherein:

the engagement element and the counter-engagement element are configured to switch between:

an engaged status in which the engagement element engages with the counter-engagement element so that a displacement of the securing member in and against a second direction relative to the housing is constrained, the second direction being perpendicular to the first direction, and a disengaged status in which the engagement element disengages from the counter-engagement element so that the securing member is adjustable relative to the housing along the second direction, the engagement element includes a projection protruding along a third direction perpendicular to the first and second directions, the counter-engagement element includes a slot, and the projection resides in the slot when the engagement element and the counter-engagement element are in the engaged status.

2. The electrical connector according to claim 1, wherein the securing member further includes a ramp formed next to the counter-engagement element in the second direction.

3. The electrical connector according to claim 1, wherein the securing member further includes a release surface formed next to the counter-engagement element in the second direction.

4. The electrical connector according to claim 1, wherein the securing member further includes a handle.

5. The electrical connector according to claim 1, wherein the securing member is an integral component and further includes a material recess configured to resiliently mount the counter-engagement element.

6. The electrical connector according to claim 1, wherein the housing includes a guide, the securing member being adjustably mounted on the housing through the guide.

7. The electrical connector according to claim 1, wherein the housing includes two slots formed in a side surface of the housing and extending along the second direction.

8. An electrical connection comprising:

an electrical connector including:

a housing;

a latch mounted on the housing, the latch being arranged relative to the housing in a first direction and including an engagement element configured to be movable in the first direction when not blocked; and a securing member arranged between the housing and the latch, the securing member including:

a supporting surface configured to support the latch in the first direction; and a counter-engagement element, wherein the engagement element and the counter-engagement element are configured to switch between:

an engaged status in which the engagement element engages with the counter-engagement element so that a displacement of the securing member in or against a second direction relative to the housing is constrained, the second direction being perpendicular to the first direction, and a disengaged status in which the engagement element disengages from the counter-engagement element so that the securing member is adjustable relative to the housing along the second direction; and a counterpart including:

a recess; and a front ridge formed next to the recess in the second direction, the front ridge being configured to:

allow the electrical connector to be inserted into the counterpart by passing below the front ridge, and constrain the latch in the recess after the electrical connector is inserted into the counterpart, wherein:

the securing member further includes a release surface formed next to the counter-engagement element in the second direction, and the front ridge is configured to, during insertion of the electrical connector into the counterpart, push against the release surface to prevent the counter-engagement element from moving along the first direction while the engagement element moves along the first direction to disengage from the counter-engagement element.

9. The electrical connection according to claim 8, wherein:

the housing includes two slots formed in a side surface of the housing and extending along the second direction, a movable ridge being formed between the two slots and movable along a third direction perpendicular to the first and second directions, the counterpart further includes a projection configured to, when the electrical connector is inserted into the counterpart, push against the movable ridge to constrain a movement of the housing in the third direction.

* * * * *